US012644238B2

(12) United States Patent
Pinson

(10) Patent No.: US 12,644,238 B2
(45) Date of Patent: Jun. 2, 2026

(54) ADJUSTABLE SCREED ASSEMBLY

(71) Applicant: Stabilcorp Pty Ltd, Wauchope (AU)

(72) Inventor: Craig Pinson, Wauchope (AU)

(73) Assignee: Stabilcorp Pty Ltd, Wauchope (AU)

( * ) Notice: Subject to any disclaimer, the term of this patent is extended or adjusted under 35 U.S.C. 154(b) by 954 days.

(21) Appl. No.: 17/771,322

(22) PCT Filed: Oct. 23, 2019

(86) PCT No.: PCT/AU2019/051161
§ 371 (c)(1),
(2) Date: Apr. 22, 2022

(87) PCT Pub. No.: WO2021/077149
PCT Pub. Date: Apr. 29, 2021

(65) Prior Publication Data

US 2022/0389665 A1 Dec. 8, 2022

(51) Int. Cl.
*E01C 19/18* (2006.01)
*E01C 19/48* (2006.01)

(52) U.S. Cl.
CPC ..... *E01C 19/48* (2013.01); *E01C 2301/14* (2013.01)

(58) Field of Classification Search
CPC ..... E01C 19/48; E01C 2301/14
USPC ..... 404/83, 104, 118
See application file for complete search history.

(56) References Cited

U.S. PATENT DOCUMENTS 4,379,653 A 4/1983 Brown
7,909,534 B1 3/2011 Comer et al.
2015/0284919 A1 10/2015 Smieja et al.
2018/0127929 A1* 5/2018 Pinson ..... E01C 19/48

FOREIGN PATENT DOCUMENTS

EP 0540725 B1 6/1995

OTHER PUBLICATIONS

Jan. 8, 2020—(WO) International Search Report and Written Opinion—PCT/AU2019/051161.

* cited by examiner

*Primary Examiner* — Raymond W Addie
(74) *Attorney, Agent, or Firm* — Banner & Witcoff, Ltd.

(57) ABSTRACT

There is provided an adjustable screed assembly suitable for mounting to a frame of a paver, the screed assembly comprising a mounting member, the mounting member having a first end and a second end, the mounting member including at least one elongate aperture passing through the mounting member and extending along the mounting member in a direction from the first end to the second end, the mounting member being pivotally connected to the frame at or proximate to the first end and being slidingly connected to a screed arm through the at least one elongate aperture, wherein the screed plate is moveable relative to the mounting member along the direction from the first end to the second end.

25 Claims, 8 Drawing Sheets

ADJUSTABLE SCREED ASSEMBLY

CROSS-REFERENCE TO RELATED APPLICATIONS

This application is a U.S. National Stage application under 35 U.S.C. § 371 of International Application PCT/AU2019/051161 (published as WO 2021/077149 A1), filed Oct. 23, 2019, and this application claims priority to and the benefit of the filing date of such prior application, which is hereby incorporated by reference in its entirety.

TECHNICAL FIELD

The present invention generally relates to a screed assembly. More particularly, the present invention relates to a screed assembly suitable for use with a paver.

BACKGROUND ART

Pavers are used to lay pavement or roadways by laying a paving material, such as asphalt, and smoothing the paving material into one or more layers. Such pavers typically include a screed assembly to flatten and smooth the paving material. The screed assembly is usually attached to the rear of the paver such that as the paver moves and disposes the paving material, the screed assembly follows behind the paver and forms the disposed material into a paved surface.

The particular position and arrangement of the screed assembly relative to the paver and/or the surface to be paved determines the characteristics of the paved surface. For instance, altering the angle or grade of the screed assembly relative to the horizontal (angle of attack) controls the amount of paving material extruded behind the screed assembly. Increasing the angle of attack will cause the screed to climb higher through the pile of paving material, and therefore raise its trailing edge, increasing the amount of material extruded behind the screed assembly. Alternatively, reducing the angle of attack will reduce the amount of material extruded.

As such, adjustability of the screed assembly is advantageous to its operation. However, the features, dimension and arrangement of the paver commonly limit the adjustability of the screed assembly. Some pavers may include some adjustable features, but they are often unnecessarily complex and integrally designed to be part of the paver. Such complexity restricts the ability to retrofit a new screed to an old paver if replacement is required.

Further, current screeds commonly have limited adjustability, which in turn limits the types of surfaces that can be paved. Further, the lack of adjustability can make them difficult to transport to and from sites that requiring paving, as they have to be driven there, usually as part of a large paving device.

The preferred embodiments of the present invention seek to address one or more of these disadvantages, and/or to at least provide the public with a useful alternative.

The reference in this specification to any prior publication (or information derived from the prior publication), or to any matter which is known, is not, and should not be taken as an acknowledgment or admission or any form of suggestion that the prior publication (or information derived from the prior publication) or known matter forms liner of the common general knowledge in the field of endeavour to which this specification relates.

DISCLOSURE OF INVENTION

This Summary is provided to introduce a selection of concepts in a simplified form that are further described below in the Detailed Description. This Summary is not intended to identify essential features of the claimed subject matter, nor is it intended to be used to limit the scope of the claimed subject matter.

In a first embodiment, there is provided an adjustable screed assembly suitable for mounting to a frame of a paver, the screed assembly comprising; a mounting member, the mounting member having a first end and a second end, the mounting member including at least one elongate aperture passing through the mounting member and extending along the mounting member in a direction from the first end to the second end, the mounting member being pivotally connected to the frame at or proximate to the first end and being slidingly connected to a screed arm through the at least one elongate aperture, wherein the screed plate is moveable relative to the mounting member along the direction from the first end to the second end.

In an embodiment, the mounting member includes a first face and a second face, the first face arranged to face the frame and the second face arranged to face the screed arm.

In an embodiment, the first face includes a first cylinder mount.

In another embodiment, the first end includes a pivot shaft arranged be received by a pair of pivot receivers arranged on the frame, such that the mounting member is pivotally connected to the frame.

In yet another embodiment, a first hydraulic cylinder is connected between a frame mount provided to the frame and the first cylinder mount, wherein the first hydraulic cylinder is arranged to pivot the mounting member with respect to the frame.

In an embodiment, the at least one elongate aperture includes a first elongate aperture, a second elongate aperture and a third elongate aperture.

In another embodiment, the screed arm includes a hinge assembly arranged to abut the second face.

In a further embodiment, the hinge assembly includes a screed arm mounting plate, wherein said screed arm mounting plate includes a screed mount.

In another embodiment, the screed arm mounting plate connects to a first backing plate and a second backing plate, the first backing plate and the second backing plate being arranged to abut the first face.

In yet another embodiment, the screed arm mounting plate is connected to the first backing plate by at least one fixing means passing through the first elongate aperture and the screed arm mounting plate is connected to the second backing plate by another at least one fixing means passing through the third elongate aperture.

In an embodiment, the screed mount is arranged to pass through the second elongate aperture.

In an embodiment, the second end of the first surface of the mounting member includes a second cylinder mount.

In an embodiment, a second hydraulic cylinder is connected between the second cylinder mount and the screed mount to enable the screed arm to be slidingly adjusted with respect to the mounting member.

In an embodiment, the hinge assembly includes a hinge portion arranged to pivotally connect the screed arm mounting plate to a screed plate.

In an embodiment, an elongate member of an adjustable length is arranged to connect between the screed arm mounting plate and the screed plate.

In an embodiment, the adjustable length of the elongate member is adjusted so that the screed plate pivots with respect to the screed arm mounting plate.

In an embodiment, the screed plate includes a first portion and a second portion, the second portion being extendable and retractable relative to the first portion.

In an embodiment, the first portion includes at least one guide rail that is arranged extend at least partially along the length of the screed plate.

In an embodiment, the second portion is arranged to slidingly travel along the at least one guide rail.

In an embodiment, a third hydraulic cylinder is arranged to connect between the first portion and the second portion, such that the second portion is extendable and retractable relative to the first portion.

In an embodiment, the second portion is in connection with an end portion.

In an embodiment, the end portion includes a hinge plate that is pivotally connected to the second portion.

In an embodiment, the hinge plate includes a limiter in connection with the end portion.

In an embodiment, wherein the first portion includes at least one stop for abutting with the hinge portion.

In another embodiment, there is provided a paver including the adjustable screed assembly in accordance with any one or more of the above embodiments.

BRIEF DESCRIPTION OF FIGURES

Example embodiments are apparent from the following description, which is given by way of example only, of at least one non-limiting embodiment, described in connection with the accompanying figures.

DETAILED DESCRIPTION

Figure 1:
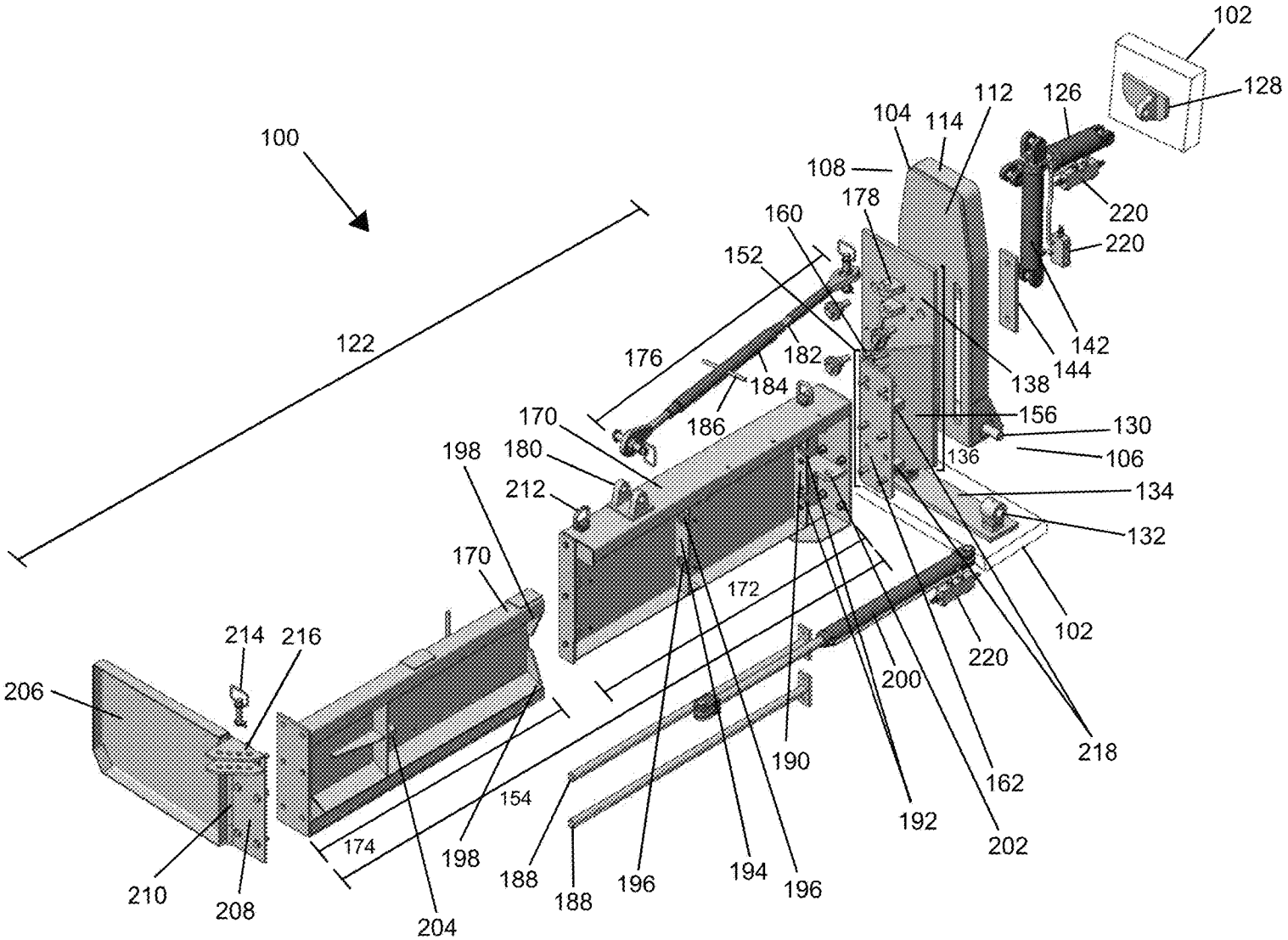
FIG. 1 illustrates an exploded view from a high angle side perspective illustrating an embodiment of the invention.
Figure 2:
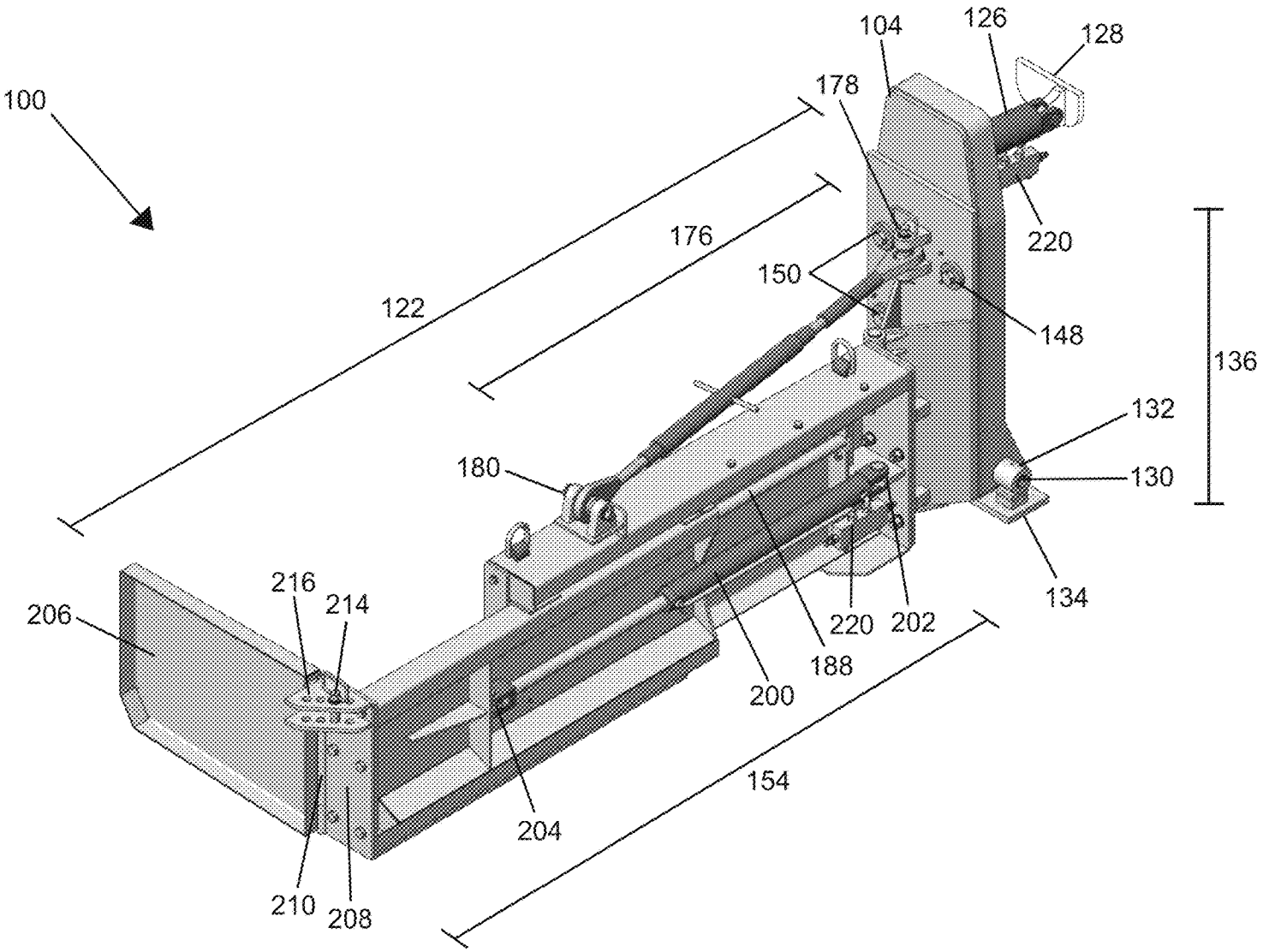
FIG. 2 illustrates a high angle side perspective view illustrating an embodiment of the invention.
Figure 3:
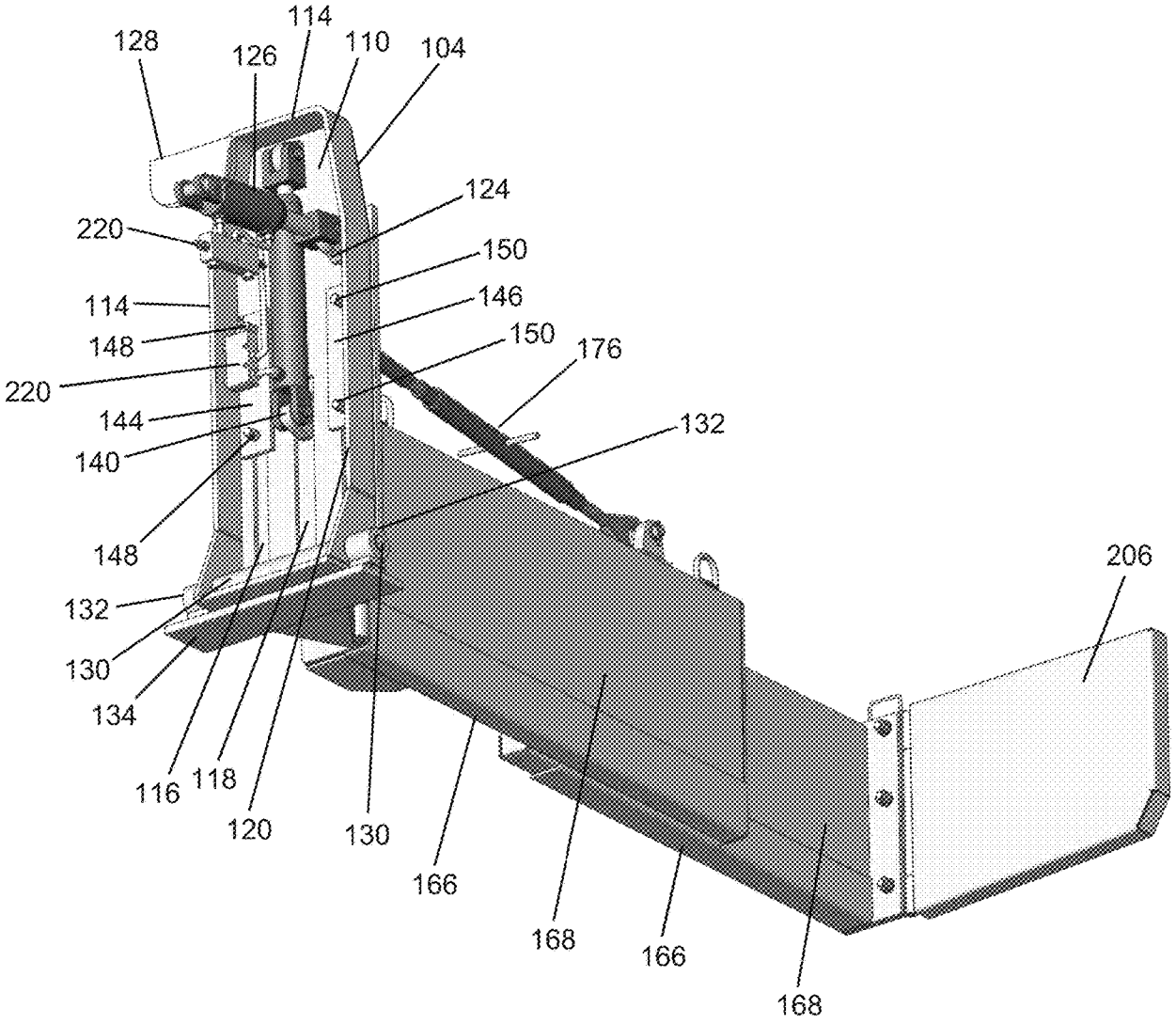
FIG. 3 illustrates a low angle alternate side perspective view of an embodiment of the invention.

The following modes, given by way of example only, are described in order to provide a more precise understanding of one or more embodiments. In the figures, like reference numerals are used to identify like parts throughout the figures.

With general reference to FIGS. 1 to 8 the invention is described in relation to an adjustable screed assembly 100 suitable for mounting to a frame 102 of a paver. A paver is an apparatus that may be mounted to a vehicle, where the vehicle may propel or drag the paver along a road surface. The vehicle may be arranged to supply the paver and screed assembly 100 with electronic or hydraulic power.

The paver may be arranged to receive paving material, such as but not limited to asphalt, gravel or cement. The paver may also be arranged to dispose the paving material onto a paving surface. For example, the paver may dispose the paving material collected by a hopper onto the paving surface by means of a conveyor belt driven by a motor, wherein the screed assembly 100 is arranged to smooth and form the paving material into a paved surface. As such, the screed assembly 100 may be arranged to be connected to the paver at an end of the paver from which the paving material is disposed and arranged to be moved in a linear motion with the paver.

The paver may be of a generally square or rectangular shape and be sufficiently rigid and robustly designed so as to accommodate being propelled or pulled by a vehicle along the paving surface. Alternatively, the paver may be moved along a paving surface when located between two vehicles. For example being arranged between a skid steer loader and a tipper truck, wherein the skid steer loader propels both the paver and the tipper truck and the tipper truck suppling the paving material to the paver. The paver may include wheels, reinforcing or connection features that enable it to be moved along a paving surface. Accordingly, an embodiment may provide a paver including the adjustable screed assembly 100 as set out below.

The screed assembly 100 may comprise a mounting member 104. The mounting member 104 may have a first end 106 and a second end 108. The mounting member 104 may also include a first face 110 and a second face 112. In an example, the first end 106 and the second end 108 may be distally arranged so that the mounting member 104 is of an elongated, substantially rectangular or polygon shape. The boundary edge of the mounting member 104 may include a lip 114 that is arranged to protrude perpendicular to a plane along which the first face 110 and second face 112 align. The lip 114 may be formed to protect any fixtures, connections or components that may be provided to the first face 110. Further, the lip 114 also provides structural reinforcement to the mounting member 104 in that the lip 114 forms a continuous and strong edge around the periphery of the mounting member 104. This feature may also seek to compensate for the loss in strength due to at least one elongate aperture being formed in the mounting member 104, where the at least one elongate aperture is described in further detail below.

Further, the mounting member 104 may include at least one elongate aperture. The at least one elongate aperture is arranged to pass through the mounting member 104 and extend along the mounting member 104 in a direction extending from the first end 106 to the second end 108. The at least one elongate aperture may form a smooth slot or guide. In one embodiment, the at least one elongate aperture may include a single elongate aperture. Alternatively, as shown in the Figs., the at least one elongate aperture may include a first elongate aperture 116, a second elongate aperture 118 and a third elongate aperture 120. The function of such apertures is discussed in further detail later in the specification.

The mounting member 104 may be arranged to enable the adjustable screed assembly 100 to be adjustable in multiple ways. For example, the mounting member 104 may be pivotally connected to the frame 102 at or proximate to the first end 106 of the mounting member 104. Further, the mounting member 104 may be slidingly connected to a screed arm 122 through the at least one elongate aperture. That is, the screed arm 122 is moveable relative to the mounting member 104 along the direction from the first end 106 to the second end 108 when sliding along the at least one elongate aperture. These aspects of the mounting member 104 will now be discussed in further detail.

In an embodiment, the first face 110 of the mounting member 104 may be arranged to face the frame 102 and the second face 112 of the mounting member 104 may be arranged to face the screed arm 122. Further, the first face 110 may include a first cylinder mount 124 which is arranged to connect to a first hydraulic cylinder 126 at a first end of the first hydraulic cylinder 126. The frame 102 may include a frame mount 128, wherein the second end of the first hydraulic cylinder 126 may be arranged to connect to a frame mount 128. For example, the first cylinder mount 124 and the frame mount 128 may each be formed in the shape of a single eye part. Further, each end of the first hydraulic cylinder 126 may include a fork part, each fork part arranged to be received within the single eye part of the frame mount 128 and the first cylinder mount 124, where each arrangement is retained by a knuckle pin. Accordingly, the first hydraulic cylinder 126 may be arranged to connect between the frame mount 128 and the first cylinder mount 124.

Within the context of the specification, the term hydraulic cylinder refers to a mechanical actuator that is used to give a unidirectional force through a unidirectional stroke. The hydraulic cylinders are powered by pressurized hydraulic fluid, which may include oil. The hydraulic fluid may be supplied by the paver or the vehicle in connection with the paver. The hydraulic cylinders may include a cylinder barrel, in which a piston connected to a piston rod moves back and forth by the pressure of the hydraulic fluid, which articulates features of the adjustable screed assembly 100 so that they may be adjustable. Further, in the context of the specification, the term fork part, single eye part and knuckle pin refers to the known and conventional names of the components of a knuckle joint.

In an embodiment, the first end 106 further includes a pivot shaft 130, wherein the lip 114 may be formed to accommodate and support the pivot member 130. The pivot shaft 130 may be arranged to pass through the lip 114 at the first end 106 of the mounting member 104. In an example, the lip 114 may extend further away from the first face 110 of the mounting member 104 so that the lip is longer at the first end 106 relative to the second end 108. As shown, the lip 114 at the first end 106 may protrude along a gradient. The extended lip reinforces the connection between the pivot shaft 130 and the mounting member 104.

In an embodiment, the pivot shaft 130 may be arranged to extend past the boundaries of the mounting member 104, where the ends of the pivot shaft 130 are arranged to be received by a pair of pivot receivers 132. The pair of pivot receivers 132 may include two hollow cylinders that are arranged to receive and retain the ends of the pivot shaft 130. The pair of pivot receivers 132 are arranged to allow the ends of the pivot shaft 130 to rotate within the pair of pivot receivers 132. The pair of pivot receivers 132 may be arranged to abut or lay flush against the outside of the lip 114 of the mounting member 104.

The pair of pivot receivers 132 may be connected to a frame plate 134, where the frame plate 134 is mounted to the frame 102. Accordingly, when the pivot shaft 130 passes through the lip 114 and the ends of the pivot shaft 130 are received within the pivot receivers 132, the mounting member 104 is pivotally connected to the frame 102. As such, the first hydraulic cylinder 126 is arranged to pivot the mounting member 104 with respect to the frame 102. The pivotal connection between the mounting member 104 and the frame 102 adjusts the grade of the adjustable screed assembly 100 with respect to the paving surface, for example a roadway, and hence the grade of the paved surface being paved by the adjustable screed assembly 100.

With particular reference to FIGS. 1, 3 to 5, the screed arm 122 includes a hinge assembly 136. The hinge assembly 136 may be arranged to abut the second face 112. The hinge assembly 136 is arranged to slidingly connect to the mounting plate 104 to enable the screed arm 122 to be slidingly moved along the direction extending from the first end 106 to the second end 106 with respect to the mounting member 104.

In an embodiment, the hinge assembly 136 may include a screed arm mounting plate 138, wherein said screed arm mounting plate 138 includes a screed mount 140. The screed mount 140 is arranged to protrude from the hinge assembly 136 through to the side of screed arm mounting plate 138 that faces the mounting member 104. The screed mount 140 may be formed in the shape of a single eye part that is arranged to connect to a fork part provided to a first end of a second hydraulic cylinder 142. Further, the screed mount 140 may be arranged on the screed arm mounting plate 138 such that the screed mount 140 passes through of the mounting member 104.

In an embodiment, where the at least one elongate aperture includes the first elongate aperture 116, second elongate aperture 118 and the third elongate aperture 120, the screed arm mounting plate 138 may be arranged to connect to a first backing plate 144 and a second backing plate 146. The first backing plate 144 and the second backing plate 146 may be arranged to abut the first face 110 of the mounting member 104. The first backing plate 144 and second backing plate 146 are sized to not be able to pass through the at least one elongate aperture. For example, the screed arm mounting plate 138 may be connected to the first backing plate 114 by at least one fixing means 148 passing through the first elongate aperture 116. Further, the screed arm mounting plate 138 may be connected to the second backing plate 146 by another at least one fixing means 150 passing through the third elongate aperture 120.

In the example embodiment, the screed mount 140 is arranged to pass through the second elongate aperture 118 and connect to a first end of the second hydraulic cylinder 142. Located proximate to or at the second end 108, the second end 108 of the first surface of the mounting member 104 may include a second cylinder mount 151, which may be formed in in the shape of a fork part, wherein the second cylinder mount 151 is arranged to connect to a second end of second hydraulic cylinder 142. For example, each end of the second hydraulic cylinder 142 may include a fork part, each fork part arranged to be received within the single eye part of the frame mount 128 and the first cylinder mount 124, each being retained by a knuckle pin. In other words, the a second hydraulic cylinder 142 is connected between the second cylinder mount 151 and the screed mount 140 to enable the screed arm 122 to be slidingly moved along the direction extending from the first end 106 to the second end 106 with respect to the mounting member 104. The sliding connection between the screed mount 140 and the mounting member 140 adjusts the height of the adjustable screed assembly 100 with respect to the paving surface, and hence the thickness of the paved surface being paved by the adjustable screed assembly 100.

The first backing member 144 and the second backing member 146 are arranged to provide support and guide the screed arm 122 to be slidingly moved along the direction extending from the first end 106 to the second end 106 with respect to the mounting member 104. However, the first backing member 144 and the second backing member 146 are not essential. As such, in an alternative embodiment, the mounting member 104 may include a single elongate aperture arranged to receive the screed mount 140. That is, screed mount 140 is arranged to provide sufficient support to the screed arm mounting plate 138 to enable the screed arm 122 to be slidingly moved along the direction extending from the first end 106 to the second end 106 with respect to the mounting member 104. In such an embodiment, the first backing member 144, the second backing member 146, the first elongate aperture 116 and the third elongate aperture 120 may not be included.

In an embodiment, the hinge assembly 136 includes a hinge portion 152 arranged to pivotally connect the screed arm mounting plate 138 to a screed plate 154. The hinge portion 152 may include a first leaf portion 156 and a second leaf portion 158, the first leaf portion 156 and the second leaf portion 158 being arranged to connect with the screed arm mounting plate 138 and with each other to form a triangular arrangement. At the join between the first leaf portion 156 and the second leaf portion 158, the hinge portion 152 includes a hinge arrangement 160. The hinge arrangement 160 is defined as an arrangement of interlocked cylindrical barrels connected to respective leaf portions, where the cylindrical barrels are all aligned to retain a pin, in accordance with the known terms of the art in relation to hinge components and construction.

In the embodiment, the hinge arrangement 160 is further connected to a third leaf portion 162 which is fixed to the screed plate 154 by fixing bolts. In other words, the third leaf portion 162 is arranged to pivot or rotate relative first leaf portion 156 and the second leaf portion 158 by means of the hinge arrangement 160. As such, the hinge assembly 136 enables the screed plate 154 to be pivotally adjusted with respect to the screed arm mounting plate 138. The hinge portion 152 may include a reinforcement plate 164 that is arranged to contact the undersides of the screed arm mounting plate 138, the first leaf portion 156 and the second leaf portion 158. The reinforcement plate 164 is provided to support the hinge portion 152 in bearing the weight of the screed plate 154. The reinforcement plate 164 may be made of a wear resistant material, such as a steel alloy material, to improve the longevity of the feature.

In an embodiment, the screed plate 156 may be formed in a single portion. The screed plate 156 may include a bottom surface 166 to smooth and compact the paving material into the paving surface. The bottom surface 166 may be arranged to align perpendicular to the direction extending from the first end 106 to the second end 106 of the mounting portion 104. Further, the screed plate 156 may also include a body surface 168, arranged to align parallel along the direction extending from the first end 106 to the second end 106 of the mounting portion 104. Moreover, the screed plate 156 may also include and top surface 170 that is arranged to align perpendicular along the direction extending from the first end 106 to the second end 106 of the mounting portion 104. In other words, the screed plate 156 may be formed in a "C" or "[" shape.

Alternatively, an embodiment is provided where the screed plate 156 includes a first portion 172 and a second portion 174. As such, each of the first portion 172 and the second portion 174 may also include a bottom surface 166, a body surface 168 and a top surface 170. As such, the "C" or "[" shape of the second portion 174 is arranged to be received within the concavity of the "C" or "[" shape of the first portion 172.

Figure 4:
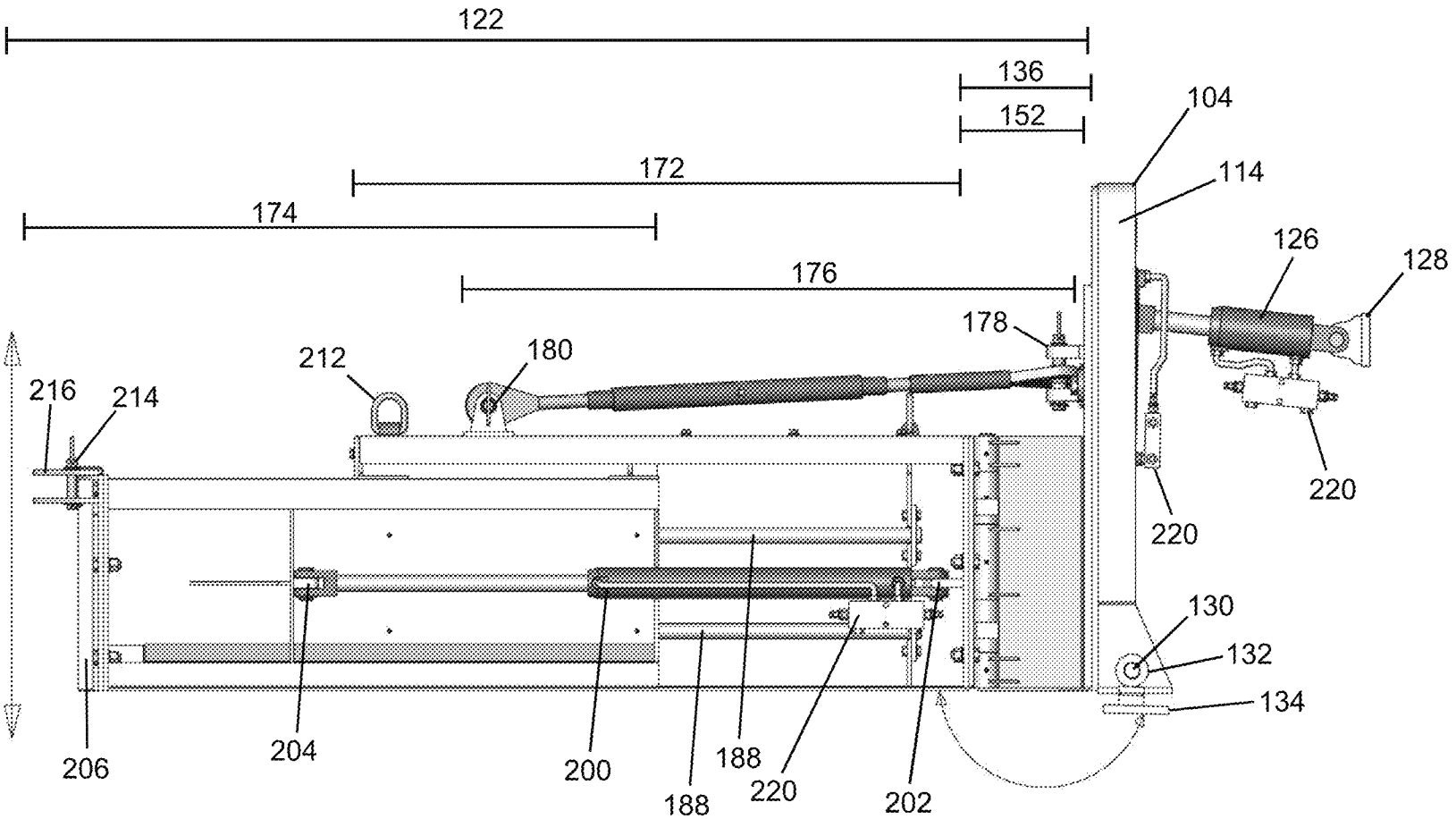
FIG. 4 illustrates a side view of an embodiment of the invention.
Figure 5:
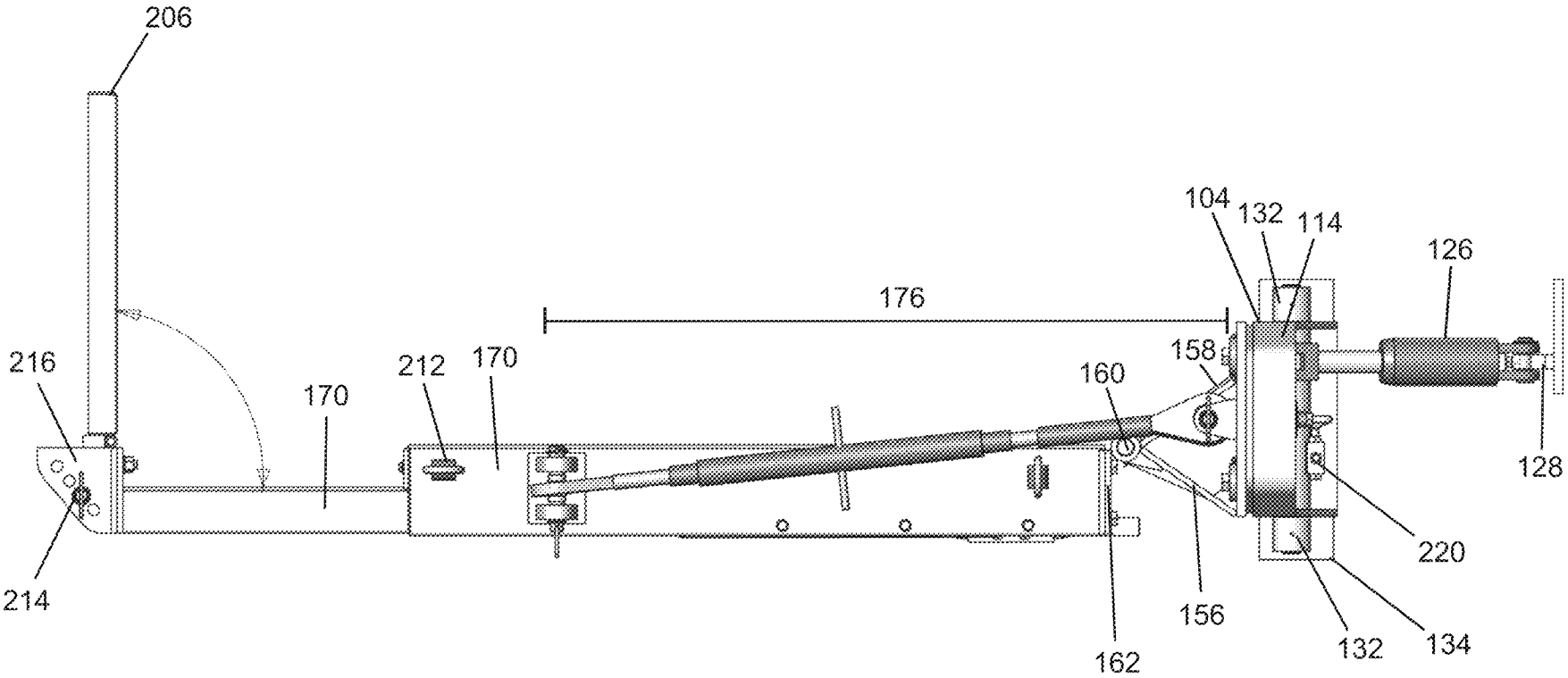
FIG. 5 illustrates a top view of an embodiment of the invention.
Figure 6:
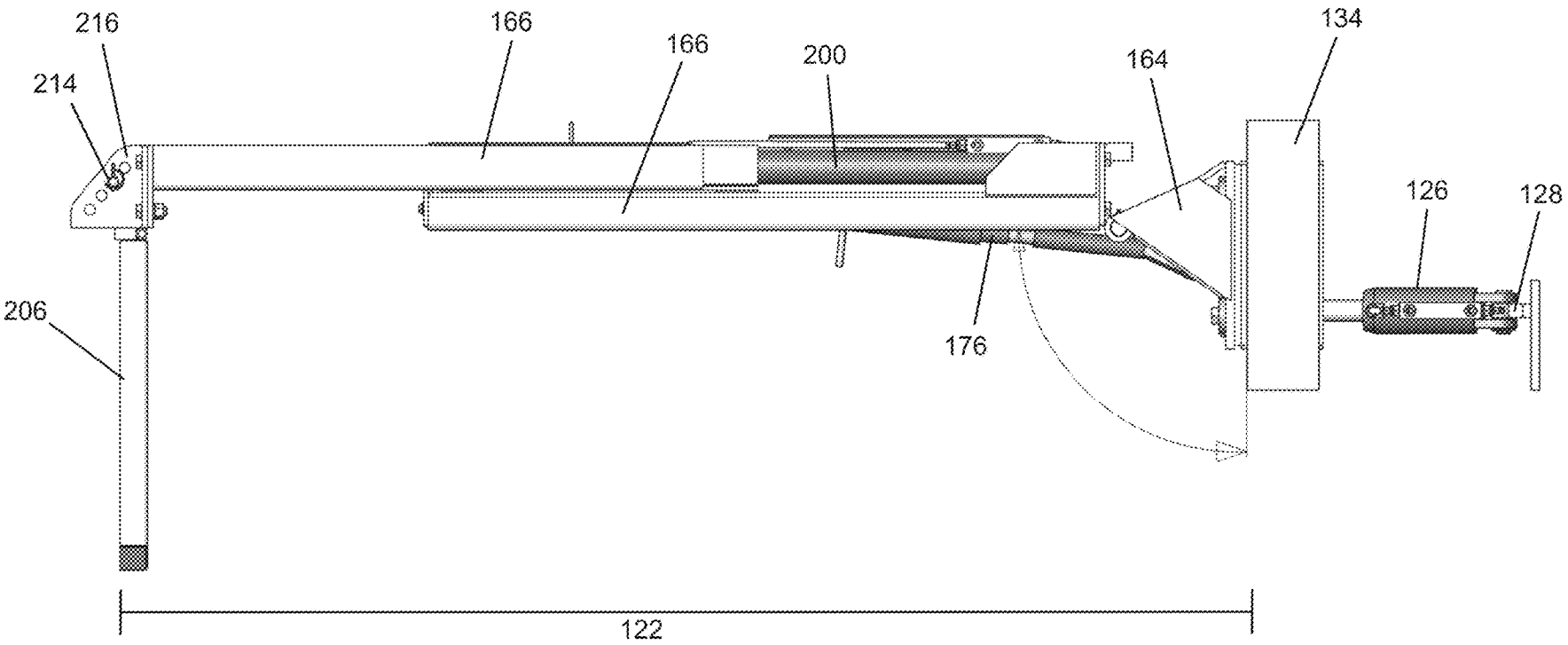
FIG. 6 illustrates a bottom view of an embodiment of the invention.
Figure 7:
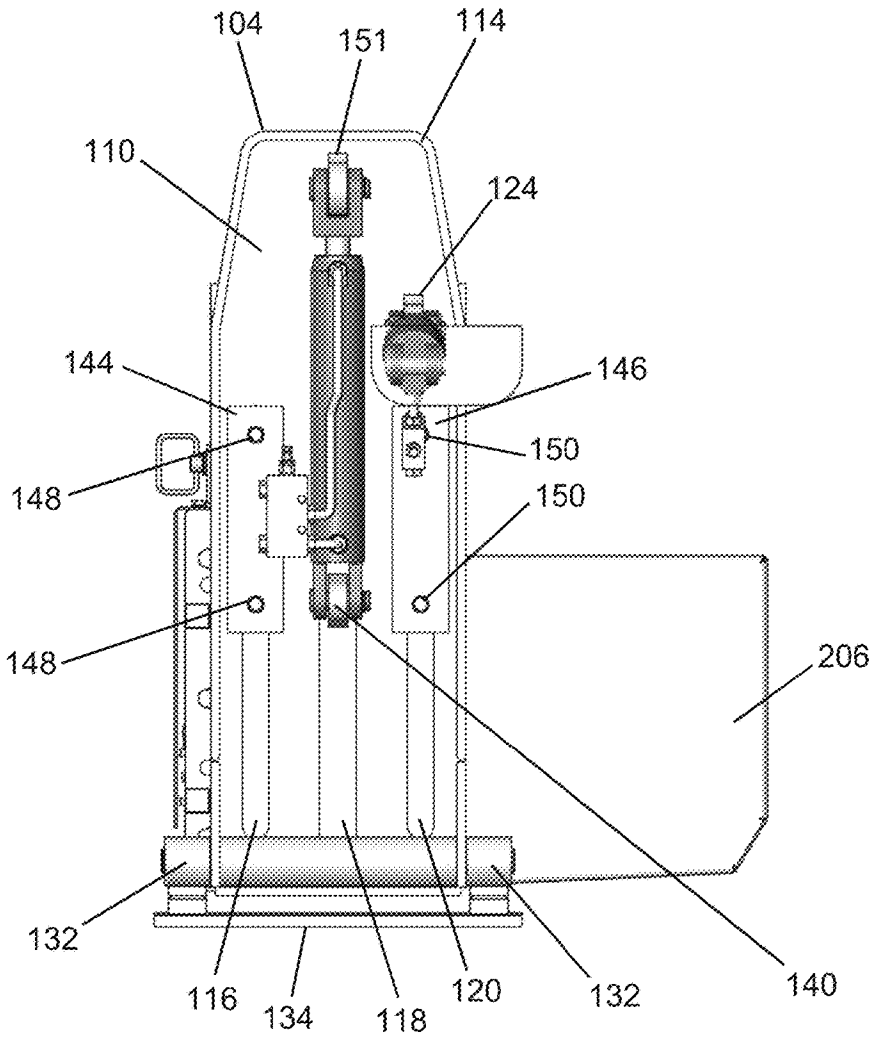
FIG. 7 illustrates a front view of an embodiment of the invention.
Figure 8:
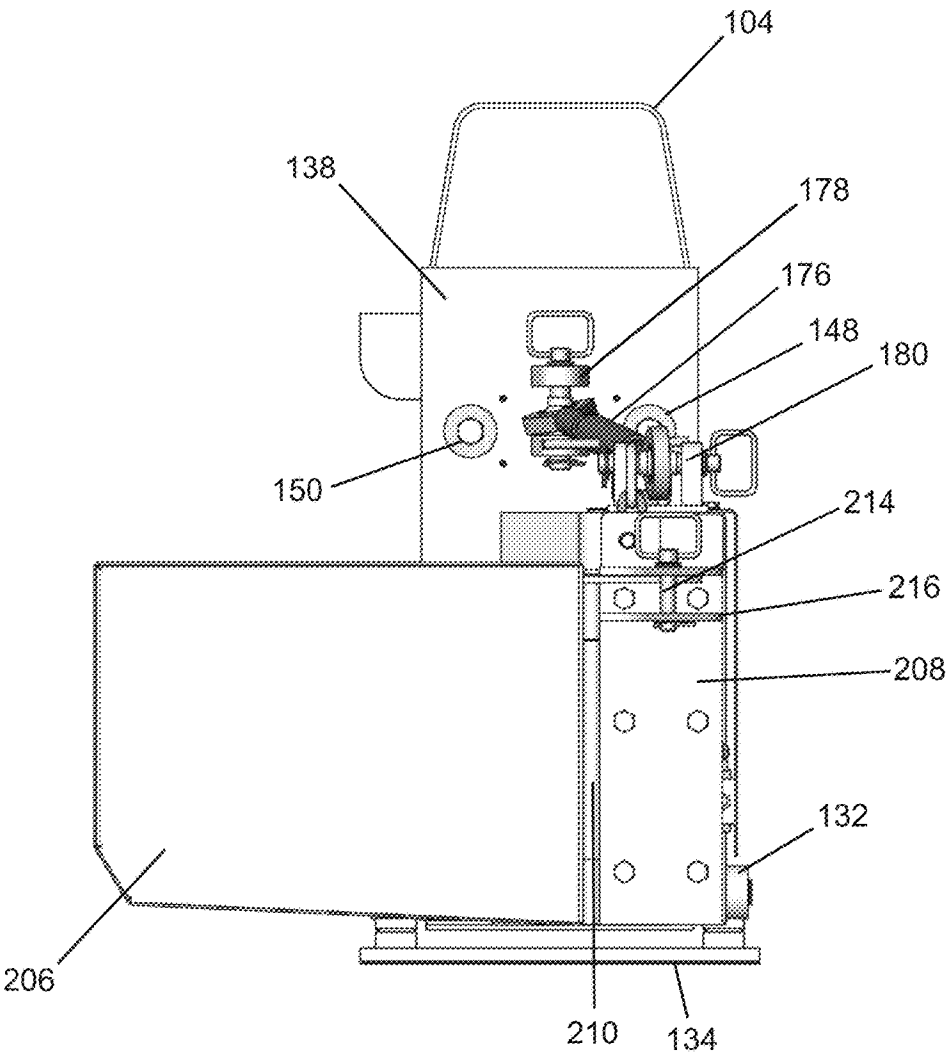
FIG. 8 illustrates a rear view of an embodiment of the invention.

Further, in an embodiment, the screed arm 122 may include an elongate member 176, the elongate member 176 may be arranged to connect between the screed arm mounting plate 138 and the screed plate 156. For example, as shown in FIGS. 4 and 5, a first end the elongate member 176 includes a single eye part that is connected to the screed arm mounting plate 138 via a first fork part 178 and a knuckle pin. Further, a second end of the elongate member 176 includes another single eye part that is connected to the top surface 170 of the first portion 172 of the screed plate 154 via second fork part 180 and another knuckle pin.

In an embodiment, the length of the elongate member 176 is adjustable. For example, the elongate member 176 may include a first elongate member portion 182 that is telescopically receivable within a second elongate member portion 184. A pin 186 may be provided to pass through one of a plurality of aligned apertures (not shown) that are provided in both the first elongate member portion 182 and the second elongate member portion 184. The pin 186 selectively fixes the first elongate member portion 182 and the second elongate member portion 184 together, such that the length of the elongate member 176 is adjustable. Adjusting the length of the elongate member 176 provides control over the arrangement of the screed plate 154 when to pivoting with respect to the screed arm mounting plate 138. In other words, when the screed arm 122 is set at the optimum angle with reference to the adjustable screed assembly 100, the material discharged from the hopper of the paver will flow easily out along the screed plate 154.

Further, the elongate member 176 is tensioned by turning the pin 186, which in turn reduces the load on the fixing bolts in the screed hinge third leaf portion 162. The pivoting connection between the screed plate 154 and the screed arm mounting plate 138 adjusts and holds the angle of the screed arm 122 at the desired angle with respect to the direction the adjustable screed assembly 100 is being moved along the paving surface.

In a further embodiment, the second portion 174 may be extendable and retractable relative to the first portion 172. In other words, the second portion 174 may be telescopically receivable by the first portion 172, such that the length of the screed plate 154 is adjustable. For example, the first portion 172 may include at least one guide rail 188 that is arranged extend at least partially along the length of the screed plate 154. For example, the at least one guide rail 188 may be fixed at or proximate to each end of the first portion 172. FIG. 4 shows the at least one guide rail 188 fixed by means of a fixing plate 190 and a plurality of fixing means, such as but not limited to bolts. The fixing plate 190 may include at least one fixing recess 192 to engage with an end of the at least one guide rail 188 and the plurality of fixing means. The fixing plate 190 may be arranged to extend in a direction perpendicular to the length of the at least one guide rail 188. Further, although not shown, a similar arrangement may be provided to attach the at least one guide rail 188 to the other end of the first portion 172.

Further, the first portion 172 may include one or more support plates 194. The one or more support plates 194 are arranged may include at least one supporting recess 196 that are arranged to receive the at least one guide rail 188. The one or more support plates 194 are arranged to extend in a direction perpendicular to the length of the at least one guide rail 188, such that they are parallel with the fixing plate 190. The one or more support plates 194 are provided to support the length of the at least one guide rail 188, particularly when the second portion 174 is arranged to slidingly travel along the at least one guide rail 188. The second portion 174 may include at least one sleeve 198 that is arranged to slidingly engage with the at least one guide rail 188 so that the second portion 174 slidingly travels along the at least one guide rail 188.

In an embodiment, a third hydraulic cylinder 200 is arranged to connect between the first portion 172 and the second portion 174, such that the second portion 174 is extendable and retractable relative to the first portion 172. A first end of the third hydraulic cylinder 200 is arranged to connect to a first portion mount 202 on the first portion 172 and a second end of the third hydraulic cylinder 200 is arranged to connect to a second portion mount 204 provided on the second portion 274. In an embodiment, the first portion mount 202 and the second portion mount 204 may each be formed as a single eye part, where the third hydraulic cylinder 200 includes a fork part at each end, the fork and eye parts arranged to receive a knuckle pin. The third hydraulic cylinder 200 enables the extending and retracting of second portion 174 relative to the first portion 172. The extending and retracting connection between the first portion 172 and the second portion 174 adjusts the length of the adjustable screed assembly 100 and the width of the paved surface being paved by the adjustable screed assembly 100.

In an embodiment, the second portion 174 may be in connection with an end portion 206. The end portion 206 may be connected to the second portion 174 at an end of the second portion 174 that is distally arranged from the first portion 172. The end portion 206 may include a hinge plate 208 that is pivotally connected to the second portion 174. That is, the hinge plate 208 may be connected to the end of the second portion 174 by means of a plurality of fixing means, where a further hinge arrangement 210 connects the hinge plate 208 to the end portion 206. As such, the end portion 208 is arranged to be pivotally moved relative to the second portion 174.

The hinge plate 208 may include a limiter in connection with the end portion. The limiter (not shown) may include a length of metal chain that is connected at a first end to a loop 212 and at a second end to an adjuster 214. The adjuster 214 may be arranged to be received within a number of positioning apertures provided to an adjuster plate 216 included in the hinge plate. This arrangement enables the rotation of the end portion 206 to be limited with respect to the second portion 174. The pivotal connection between the end portion 206 and the second portion 174 retains the paving material being paved by ensuring that all the paving material passes under the under first portion 172 and second portion 174. Therefore, the end portion 206 and the second portion 174 are arranged to ensure that all material being paved passes out from under the adjustable screed assembly 100 at a level that is consistent, i.e. level and smooth.

In a further embodiment, the first portion 172 may include at least one stop 218 for abutting with the hinge portion 136. The at least one stop 218 is arranged to limit the pivotal movement of screed arm 122 relative to the hinge assembly 136. This prevents the screed arm 122 from moving too far damaging the screed assembly 100, for example causing the elongate member 176 to fail due to subjecting it to large bending moment.

In an embodiment, each of the first hydraulic cylinder 126, second hydraulic cylinder 142 and third hydraulic cylinder 200 may include a hydraulic controller 220. The hydraulic controller 220 is provided to the adjustable screed assembly 100 proximate to each of the respective cylinders to enable and control the inflow and outflow of hydraulic fluid to each cylinder. Each of the hydraulic controllers 220 are provided to control the operation of the respective cylinder through the inflow and outflow of hydraulic fluid for each cylinder at such a rate to enable safe operation of the cylinders.

In the foregoing description of preferred embodiments, specific terminology has been resorted to for the sake of clarity. However, the invention is not intended to be limited to the specific terms so selected, and it is to be understood that each specific term includes all technical equivalents, which operate in a similar manner to accomplish a similar technical purpose. Terms such as "front" and "rear", "above" and "below" and the like are used as words of convenience to provide reference points and are not to be construed as limiting terms.

Optional embodiments may also be said to broadly include the parts, elements, steps and/or features referred to or indicated herein, individually or in any combination of two or more of the parts, elements, steps and/or features, and wherein specific integers are mentioned which have known equivalents in the art to which the invention relates, such known equivalents are deemed to be incorporated herein as if individually set forth.

Although a preferred embodiment has been described in detail, it should be understood that modifications, changes, substitutions or alterations will be apparent to those skilled in the art without departing from the scope of the present invention.

Throughout this specification and the claims which follow, unless the context requires otherwise, the word "comprise", and variations such as "comprised", "comprises" or "comprising", will be understood to imply the inclusion of a stated integer or step or group of integers or steps but not the exclusion of any other integer or step or group of integers or steps.

As used herein, a, an, the, at least one, and one or more are used interchangeably, and refer to one or to more than one (i.e. at least one) of the grammatical object. By way of example, "an element" means one element, at least one element, or one or more elements.

In the context of this specification, the term "about" is understood to refer to a range of numbers that a person of skill in the art would consider equivalent to the recited value in the context of achieving the same function or result.

The terms "top", "side", bottom", "rear" and "front" are used to describe the relative views of the figures and the general position of some features relative to other features, and as such, is not to be considered limiting.

The embodiments described herein provide a novel means of adjusting a screed assembly. The embodiments provide an adjustable screed assembly with unsurpassed adjustability. That is, embodiments provided include a screed that is adjustable in five different planes or axes, by means of; the pivotable mounting member, the slidable screed arm mounting plate, the pivotable hinge assembly, the extendable and retractable screed plate and the pivotable end portion. This enables not only adjustability in the extension, height and grade of the screed assembly, but also in the shape into which the paving surface is paved.

Further, the adjustability of the screed assembly enables the operator of the screed assembly and/or paver a greater level of control when undertaking the paving process. A greater level of control of the process leads to a higher quality paving surface. A high quality paving surface has many flow on benefits including a smoother surface and a reduced wear rate.

Furthermore, the adjustability of the screed assembly enables for more complex paving operations to be undertaken or paving operations with restructured or limited access to the surface to be paved.

Moreover, the adjustable screed assembly, particularly the first portion and the second portion of the screed plate, permits the operator of the paver to retract the screed by remote control during operation to avoid collision with roadside obstacles such as road signs, then once the obstacle is passed, to quickly return to the desired screed plate length.

Further, the pivotable hinge assembly permits the operator of the paver to set the angle of the screed to best suit the characteristics of the paving material.

The invention claimed is:

1. An adjustable screed assembly suitable for mounting to a frame of a paver, the screed assembly comprising;

a mounting member, the mounting member having a first end and a second end, the mounting member including at least one elongate aperture passing through the mounting member and extending along the mounting member in a direction from the first end to the second end, the mounting member configured to be pivotally connected to the frame at or proximate to the first end and being slidingly connected to a screed arm through the at least one elongate aperture, wherein the screed arm is moveable relative to the mounting member along the direction from the first end to the second end.

2. The adjustable screed assembly in accordance with claim 1, wherein the mounting member includes a first face and a second face, the first face configured to face the frame and the second face arranged to face the screed arm.

3. The adjustable screed assembly in accordance with claim 2, wherein the first face includes a first cylinder mount, and/or wherein the first end includes a pivot shaft arranged be received by a pair of pivot receivers configured to on the frame, such that the mounting member is configured to be pivotally connected to the frame.

4. A paver including the adjustable screed assembly in accordance with claim 1.

5. The adjustable screed assembly in accordance with claim 3, wherein a first hydraulic cylinder is configured to be connected between a frame mount provided to the frame and the first cylinder mount, wherein the first hydraulic cylinder is configured to pivot the mounting member with respect to the frame.

6. The adjustable screed assembly in accordance with claim 2, wherein the at least one elongate aperture includes a first elongate aperture, a second elongate aperture and a third elongate aperture.

7. The adjustable screed assembly in accordance with claim 6, wherein the screed arm includes a hinge assembly arranged to abut the second face.

8. The adjustable screed assembly in accordance with claim 7, wherein the hinge assembly includes a screed arm mounting plate, wherein said screed arm mounting plate includes a screed mount.

9. The adjustable screed assembly in accordance with claim 8, wherein the screed arm mounting plate connects to a first backing plate and a second backing plate, the first backing plate and the second backing plate being arranged to abut the first face.

10. The adjustable screed assembly in accordance with claim 9, wherein the screed arm mounting plate is connected to the first backing plate by at least one fixing means passing through the first elongate aperture and the screed arm mounting plate is connected to the second backing plate by another at least one fixing means passing through the third elongate aperture.

11. The adjustable screed assembly in accordance with claim 10, wherein the screed mount is arranged to pass through the second elongate aperture.

12. The adjustable screed assembly in accordance with claim 11, wherein the second end of the first face of the mounting member includes a second cylinder mount.

13. The adjustable screed assembly in accordance with claim 12, wherein a second hydraulic cylinder is connected between the second cylinder mount and the screed mount to enable the screed arm to be slidingly adjusted with respect to the mounting member.

14. The adjustable screed assembly in accordance with claim 8, wherein the hinge assembly includes a hinge portion arranged to pivotally connect the screed arm mounting plate to the screed arm.

15. The adjustable screed assembly in accordance with claim 14, wherein an elongate member of an adjustable length is arranged to connect between the screed arm mounting plate and the screed arm.

16. The adjustable screed assembly in accordance with claim 15, wherein the adjustable length of the elongate member is adjusted so that the screed arm is pivotable with respect to the screed arm mounting plate.

17. The adjustable screed assembly in accordance with claim 1, wherein the screed arm includes a first portion and a second portion, the second portion being extendable and retractable relative to the first portion.

18. The adjustable screed assembly in accordance with claim 17, wherein the first portion includes at least one guide rail that is arranged extend at least partially along a length of the screed arm.

19. The adjustable screed assembly in accordance with claim 18, wherein the second portion is arranged to slidingly travel along the at least one guide rail.

20. The adjustable screed assembly in accordance with claim 19, wherein a third hydraulic cylinder is arranged to connect between the first portion and the second portion, such that the second portion is extendable and retractable relative to the first portion.

21. The adjustable screed assembly in accordance with claim 17, wherein the second portion is in connection with an end portion.

22. The adjustable screed assembly in accordance with claim 21, wherein the end portion includes a hinge plate that is pivotally connected to the second portion.

23. The adjustable screed assembly in accordance with claim 22, wherein the hinge plate includes a limiter in connection with the end portion.

24. The adjustable screed assembly in accordance with claim 17, wherein the mounting member includes a first face and a second face, the first face configured to face the frame and the second face arranged to face the screed arm, wherein the at least one elongate aperture includes a first elongate aperture, a second elongate aperture and a third elongate aperture, wherein the screed arm includes a hinge assembly arranged to abut the second face, wherein the hinge assembly includes a hinge portion arranged to pivotally connect a screed arm mounting plate to the screed arm, and wherein the first portion includes at least one stop for abutting with the hinge portion.

25. An adjustable screed assembly suitable for mounting to a frame of a paver, the screed assembly comprising;

a screed arm mounting plate;

a screed arm pivotably connected to the screed arm mounting plate and configured for use in a paving operation of the paver;

a mounting member, the mounting member having a first end and a second end, the mounting member including at least one elongate aperture passing through the mounting member and extending along the mounting member in a direction from the first end to the second end, the mounting member configured to be pivotally connected to the frame at or proximate to the first end and being slidingly connected to the screed arm mounting plate through the at least one elongate aperture, wherein the screed arm is moveable relative to the mounting member along the direction from the first end to the second end, by the screed arm mounting plate being slidingly connected to the mounting member through the at least one elongate aperture, such that the screed arm is moveable with the screed arm mounting plate.

* * * * *